US006483394B2

(12) United States Patent
Kim

(10) Patent No.: US 6,483,394 B2
(45) Date of Patent: Nov. 19, 2002

(54) ISOLATOR WITH CAPACITORS AND CHIP RESISTORS LOCATED OUTSIDE OF THE HOUSING

(75) Inventor: Chang Sik Kim, Suwon (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 09/731,777

(22) Filed: Dec. 8, 2000

(65) Prior Publication Data

US 2001/0040484 A1 Nov. 15, 2001

(30) Foreign Application Priority Data

Dec. 16, 1999 (KR) ..... 99-58202
Nov. 24, 2000 (KR) ..... 00-70183

(51) Int. Cl.[7] ..... H01P 1/361; H01P 1/383
(52) U.S. Cl. ..... 333/24.2; 333/1.1
(58) Field of Search ..... 333/1.1, 24.2

(56) References Cited

U.S. PATENT DOCUMENTS 5,172,080 A * 12/1992 Fisher et al. ..... 333/1.1
6,037,844 A 3/2000 Makino et al. ..... 333/1.1

FOREIGN PATENT DOCUMENTS

JP 5-315814 A * 11/1993 ..... 333/24.2
JP 6-140813 A * 5/1994 ..... 333/1.1

* cited by examiner

*Primary Examiner*—Justin P. Bettendorf
(74) *Attorney, Agent, or Firm*—Lowe Hauptman Gilman & Berner, LLP

(57) ABSTRACT

An isolator is disclosed, in which a ferromagnetic sheet is placed into a shielding resin case together with garnet ferrite and an internal terminal sheet (with strip lines extending therefrom). Thus the leakage magnetic flux shielding effect is reinforced, and the bulk of the isolator is made compact. The constitution is as follows. That is, the internal terminal sheet (with the strip lines extending therefrom), a garnet ferrite, a plurality of insulating films and a ferromagnetic sheet are inserted into a shielding resin case in the cited order. Further, this structure is inserted into between upper and lower cases, and three dielectric devices and a chip resistor are disposed on a PCB and around the lower case, while a connecting terminal part with input/output terminals connected to the PCB electrodes is formed on the PCB.

14 Claims, 7 Drawing Sheets

ISOLATOR WITH CAPACITORS AND CHIP RESISTORS LOCATED OUTSIDE OF THE HOUSING

FIELD OF THE INVENTION

The present invention relates to an isolator used in the microwave apparatuses. More specifically, the present invention relates to an isolator in which a ferromagnetic sheet (Sr-ferrite) together with an internal terminal sheet (with strip lines extending therefrom) and a garnet ferrite is inserted into a shielding case; dielectric devices and a chip resistor are installed on a PCB and around the shielding case; a connecting terminal sheet is formed; and thus the ferromagnetic sheet is securely placed by means of the strip lines of the internal terminal sheet and the garnet ferrite of the shielding case, so that the leakage magnetic flux shielding effect can be reinforced, that the bulk of the isolator can be made compact, that the assemblability can be improved, and that the manufacturing process can be simplified.

BACKGROUND OF THE INVENTION

The generally known conventional isolator is inserted to between an antenna switch and a power amplifier module of a wireless apparatus, so that the signals reflected from the antenna switch are absorbed, thereby protecting the power amplifier module.

FIG. 1 is a block diagram of a system involving the isolator. As shown in this drawing, transmission signals Tx are amplified by a power amplifier module 15, are filtered by a low pass filter 14, and are sent through an antenna switch 12 to an antenna 11, so that the signals can be transmitted from the antenna 11.

Meanwhile, reception signals Rx are received by the antenna 11, and are sent through the antenna switch 12 to a band pas filter 16 so as to be filtered. Generally, an isolator 13 is disposed between the antenna switch 12 and the power amplifier module 15 of the wireless apparatus, so that the signals reflected from the antenna switch 12 can be absorbed, thereby protecting the power amplifier module 15.

FIG. 2 illustrates the basic equivalent circuit for the isolator. As shown in this drawing, an input terminal is coupled to an output part of the power amplifier module 15 of the transmitting part so as to receive the transmission signals Tx. Further, the input terminal block is connected an internal terminal block 22, and thus, the high frequency transmission signals Tx are transferred to the internal terminal block 22. An input capacitor C1 is connected between the input terminal block and the ground.

Further, an output terminal block is connected to the internal terminal block 22, while the other end of the output terminal block is connected to the antenna switch 12, so that the high frequency signals can be finally transmitted from the antenna 11.

An output capacitor C2 is connected between the output terminal block and the ground. A ground capacitor C3 and a longitudinal resistor R (50Ω) are connected in parallel between the internal terminal block 22 and the ground. The signals which have been transferred from the power amplifier module 15 through the input terminal block and the internal block to the output terminal block can reversely flow partly from the antenna switch 12. These returned signals are sunk into the ground from the internal block 22 through the longitudinal resistor R.

Therefore, the isolator 13 removes the power of the returning signals so as to ultimately prevent the power amplifier module 15 from being damaged by the power of the returning signals, thereby protecting the power amplifier module 15.

FIG. 3 is an exploded perspective view showing the constitution of the conventional isolator. As shown in this drawing, the isolator includes: an upper case 31; a ferromagnetic sheet (Sr-ferrite) 32 for generating a constant magnetic field; an internal terminal block 33 disposed under the ferromagnetic sheet 32, for generating an induced magnetic field, and including a garnet ferrite 42 and three strip lines 33' connected to the input and output terminal blocks and to the ground; dielectric devices 35*a*–35*c* and a chip resistor 34 respectively connected to the three strip lines 33' of the internal terminal block 33; an injection-molded case 36 having through holes 41 for fastening the internal terminal block 33, and having spaces for receiving the chip resistor 34 and the three dielectric devices 35*a*–35*c*, with input/output electrodes 38 and 39 and a ground electrode 37 being accommodated therein; and a lower case 40.

In this conventional isolator, the arrangement of the components is as follows. That is, the ferromagnetic sheet 32 and the garnet ferrite 42 are accommodated into the separate injection-molded case 36. Further, the three dielectric devices 35*a*–35*c*, the input/output electrodes 38 and 39, and the ground electrode 37 are horizontally arranged, and they are connected through the strip lines of the internal terminal block 33. Accordingly, the sizes of the dielectric devices, the chip resistor and the garnet ferrite are increased, and therefore, the overall bulk of the isolator is expanded.

Further, when the strip lines 33' of the internal terminal block 33 are soldered to the dielectric devices 35*a*–35*c* and to the input/output electrodes 38 and 39, soldering defects are apt to occur due to the narrow space within the injection-molded case 36, as well as degrading the workability and the assemblability of the isolator, and making it impossible to obtain uniform products.

SUMMARY OF THE INVENTION

The present invention is intended to overcome the above described disadvantages of the conventional technique.

Therefore it is an object of the present invention to provide an isolator in which a ferromagnetic sheet is securely placed by means of strip lines of an internal terminal sheet and a garnet ferrite, thereby improving the shielding of the leakage magnetic flux to the degree of maximizing the shielding effect.

It is another object of the present invention to provide an isolator in which dielectric devices and a chip resistor are installed on a circuit board of the shielding case, thereby making the bulk of the isolator compact, making the response to the frequency easy, and making the characteristics of the product stable.

It is still another object of the present invention to provide an isolator in which the isolator can be easily installed on a circuit board, thereby improving the assemblability, and simplifying the manufacturing process.

In achieving the above objects, the isolator according to the present invention includes: upper and lower cases; a ferromagnetic sheet disposed within a shielding case, for generating a constant magnetic field; an internal terminal sheet having a plurality of strip lines for being connected to input/output electrode terminals and aground terminal and disposed under the ferromagnetic sheet and a garnet ferrite, the garnet ferrite being for generating an induced magnetic field; and the input/output electrode terminals and a chip resistor and three dielectric devices for being connected to the three strip lines of the internal terminal sheet, wherein the ferromagnetic sheet is inserted into the shielding case together with the garnet ferrite and the internal terminal sheet (with the strip lines extending therefrom), the shielding case is inserted into a lower metal case, the three dielectric devices and the chip resistor are installed on a circuit board and around the lower metal case, and a connecting terminal part having the input/output electrode terminals is formed.

In another aspect of the present invention, the isolator according to the present invention includes: upper and lower cases; a ferromagnetic sheet disposed within a shielding case, for generating a constant magnetic field owing to an input current; an internal terminal sheet having a plurality of strip lines for being connected to input/output electrode terminals and a ground terminal and disposed under the ferromagnetic sheet and a garnet ferrite, the garnet ferrite being for generating an induced magnetic field; and the input/output electrode terminals and a chip resistor and three dielectric devices for being connected to the three strip lines of the internal terminal sheet, wherein the ferromagnetic sheet is inserted into the shielding resin case together with the garnet ferrite and the internal terminal sheet (with the strip lines extending therefrom) and a plurality of insulating films, the shielding case is inserted into a lower metal case (serving as a ground), the three dielectric devices and the chip resistor are installed on a circuit board and around the lower metal case, and a connecting terminal part having the input/output electrode terminals is formed.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENTS

Figure 1:
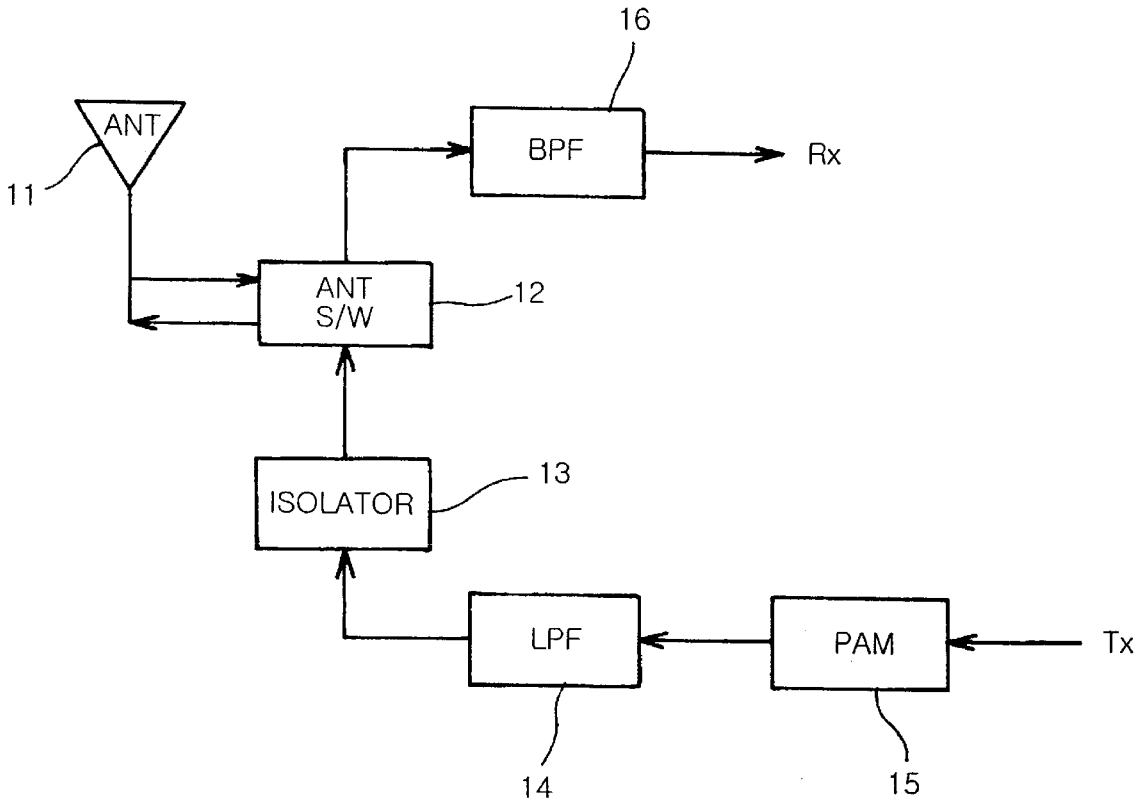
PRIOR ART FIG. 1
FIG. 1 is a block diagram of a system involving the isolator.
Figure 2:
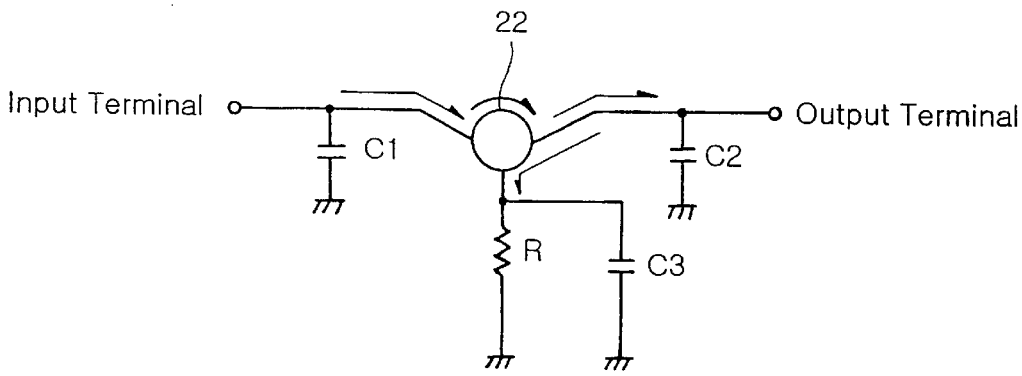
PRIOR ART FIG. 2
FIG. 2 illustrates the basic equivalent circuit for the isolator.
Figure 3:
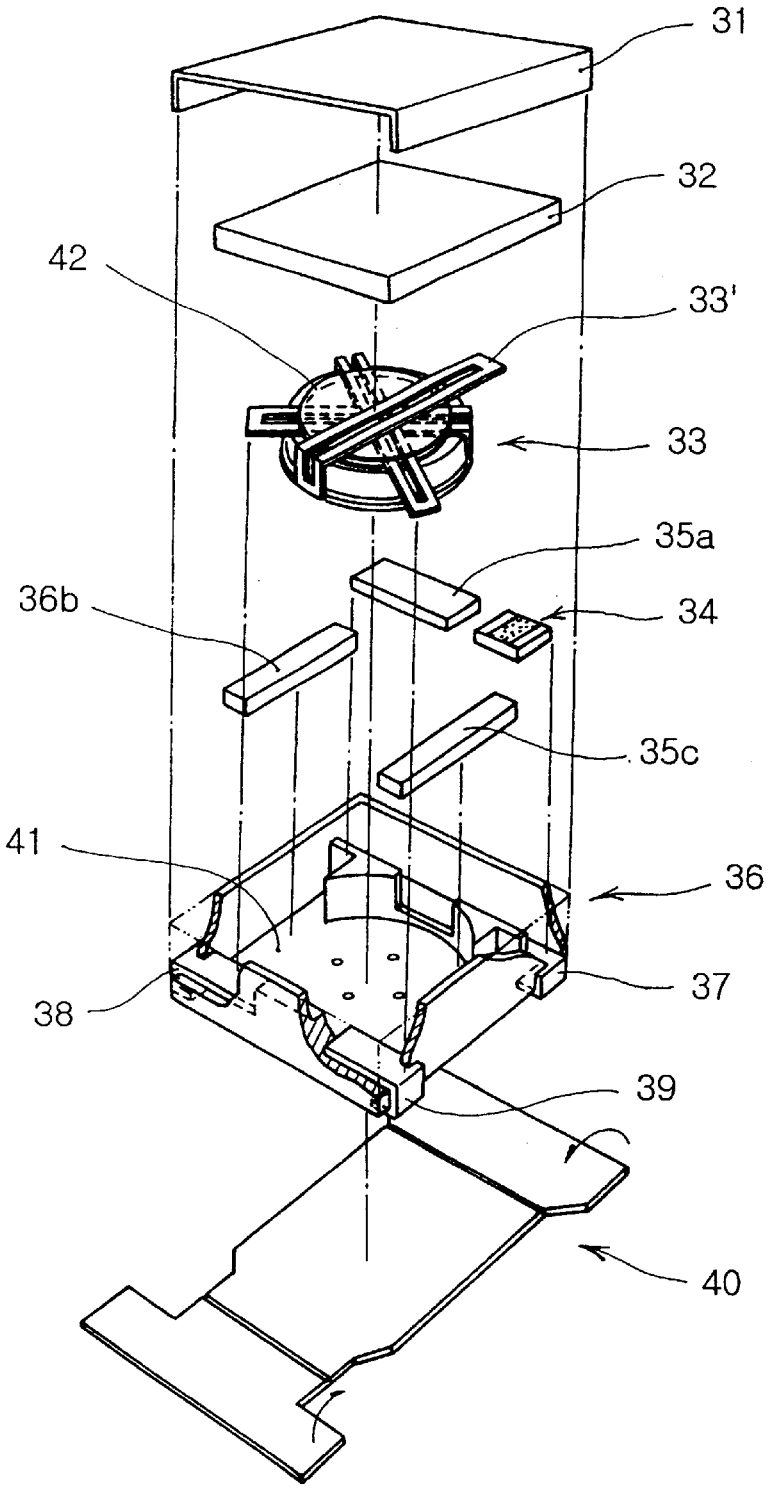
PRIOR ART FIG. 3
FIG. 3 is an exploded perspective view showing the constitution of the conventional isolator.
Figure 4:
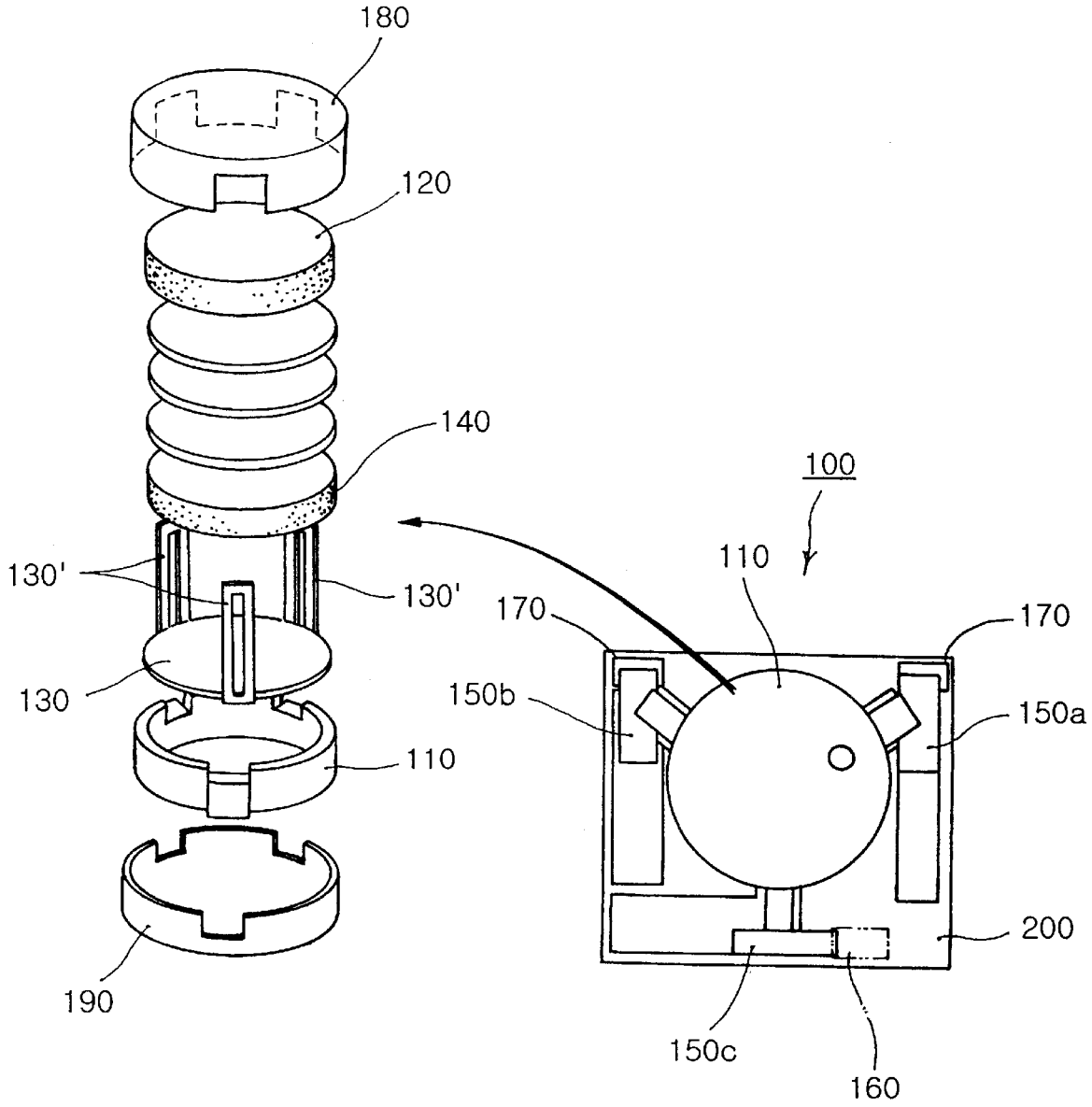
FIG. 4 is an exploded perspective view showing the constitution of the isolator according to the present invention.
Figure 5:
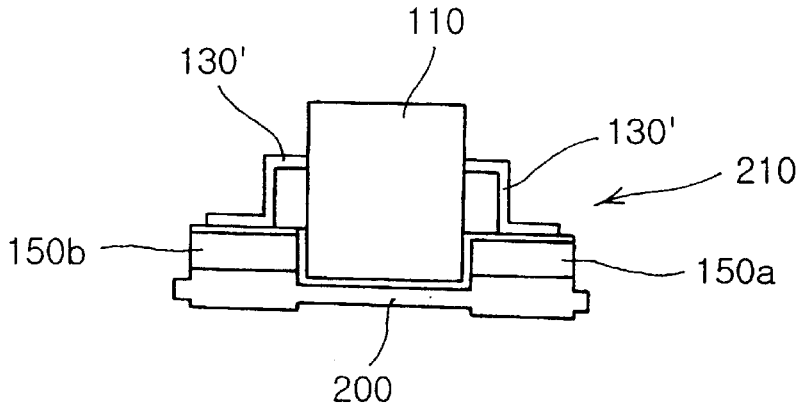
FIG. 5 is a sectional view showing the structure of the isolator before coupling the shielding case.
Figure 6A:
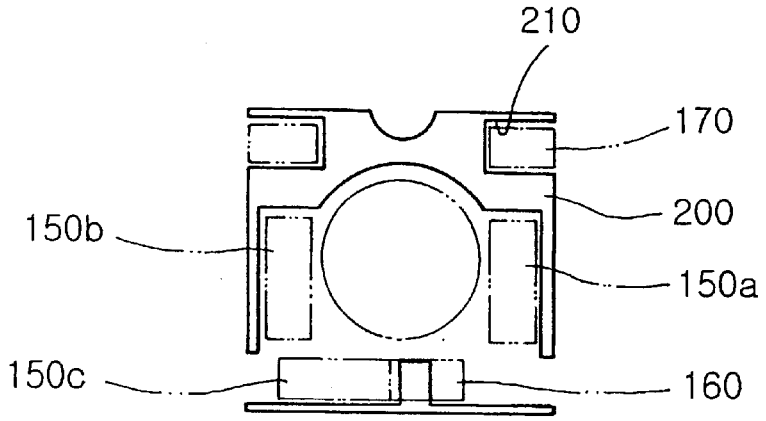
FIGS. 6*a* and 6*b* are respectively a plan view and a bottom view of a cavity PCB on which the isolator of the present invention is installed.
Figure 6B:
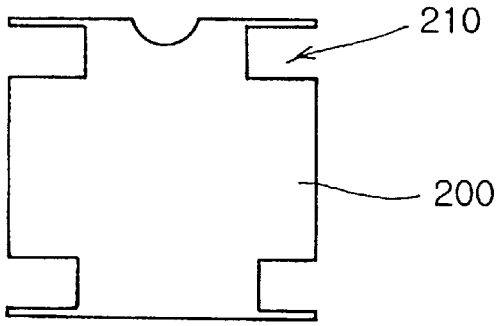

FIG. 4 is an exploded perspective view showing the constitution of the isolator according to the present invention. FIG. 5 is a sectional view showing the structure of the isolator before coupling the shielding case. FIG. 6 illustrates a cavity PCB on which the isolator of the present invention is installed. As shown in these drawings, the isolator 100 according to the present invention includes: a ferromagnetic sheet 120 disposed between and within upper and lower cases 180 and 190, for generating a constant magnetic field; a garnet ferrite 140 disposed under the ferromagnetic sheet 120, for generating an induced magnetic field, with a plurality of insulating films disposed above it; an internal terminal sheet disposed under the garnet ferrite 140; and a plurality of strip lines 130' extending up from the internal terminal sheet 130 to above the garnet ferrite 140.

Further, the strip lines 130' of the internal terminal sheet 130 are connected to a chip resistor 160, to three dielectric devices 150*a*–150*c*, and to input/output electrode terminals 170 by soldering.

Under this condition, the ferromagnetic sheet 120 is inserted into a shielding case 110, with the garnet ferrite 140 and the internal terminal sheet 130 (the strip lines 130' extending therefrom) being involved therein. A shielding is done by the upper and lower metal cases 180 and 190. The chip resistor 160 and the three dielectric devices 150*a*–150*c* are installed on a PCB 200 and around the lower case 190. Then a connecting terminal part 210 with input/output terminals 170 inserted therein is formed.

Now the present invention which is constituted as above will be described as to its action and effects.

As shown in FIGS. 4 to 6, in the isolator according to the present invention, the ferromagnetic sheet 120 which generates a constant magnetic field is disposed within the shielding case 110. In this state, under the ferromagnetic sheet 120, there is disposed the internal terminal sheet 130 from which the strip lines 130' extend to be contacted to the input/output terminals 170.

Under this condition, the strip lines 130' of the internal terminal sheet 130 are connected to the three dielectric devices 150*a*–150*c* and to the input/output electrode terminals 170 by soldering, thereby completing the isolator of the present invention.

Meanwhile, in the isolator 100, the ferromagnetic sheet 120 is inserted into a shielding case 110, with the garnet ferrite 140 and the strip lines 130' of the internal terminal sheet 130 being involved therein. Thus the variations of the magnetic field due to the damage or loose movements during its assembling can be inhibited, thereby reinforcing the leakage magnetic flux shielding effect.

Further, on the PCB 200 (which is made of a ceramic or alumina) and around the shielding case 110, there are installed the chip resistor 160 and the three dielectric devices 150*a*–150*c*. Then a connecting terminal part 210 with the input/output terminals 170 formed therein is formed on the PCB 200. As a result, the assemblability of the terminals is improved, while the chip resistor 160, the three dielectric devices 150*a*–150*c* and the input/output terminals 170 can be easily connected to the strip lines 130' of the internal terminal sheet 130 by soldering. The strip lines 130' extend from the inside of the shielding case 110 to its outside. Further, the shielding case 110 can be made to directly serve as the ground terminal.

Figure 7A:
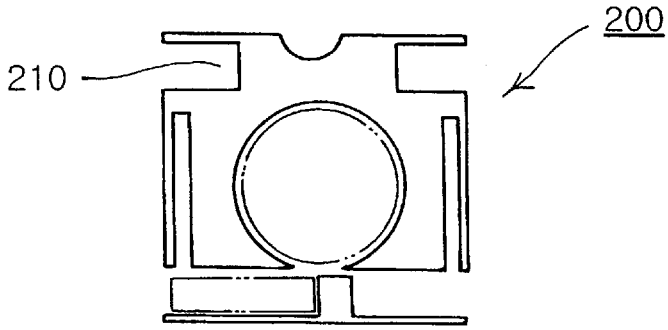
FIGS. 7*a* and 7*b* are respectively a plan view and a bottom view of a cavity PCB on which another embodiment of the isolator of the present invention is installed.
Figure 7B:
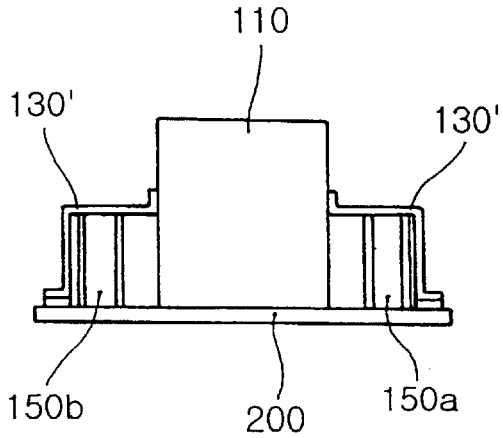
Figure 8:
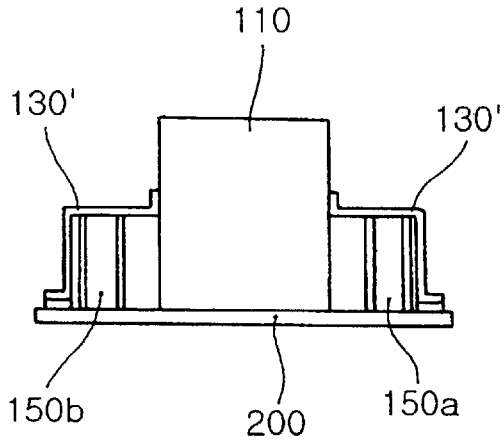
FIG. 8 is a frontal sectional view showing the assembled isolator which is installed on the PCB of FIG. 7.

Meanwhile, FIGS. 7*a* and 7*b* are respectively a plan view and a bottom view of a PCB on which another embodiment of the isolator of the present invention is installed. As shown in these drawings, the ferromagnetic sheet and the garnet ferrite of the isolator 100 are inserted into the center of the PCB 200'. In this state, on the PCB 200' and around the shielding case 110, the three dielectric devices 150*a*–150*c* can be made to upstand.

Figure 9:
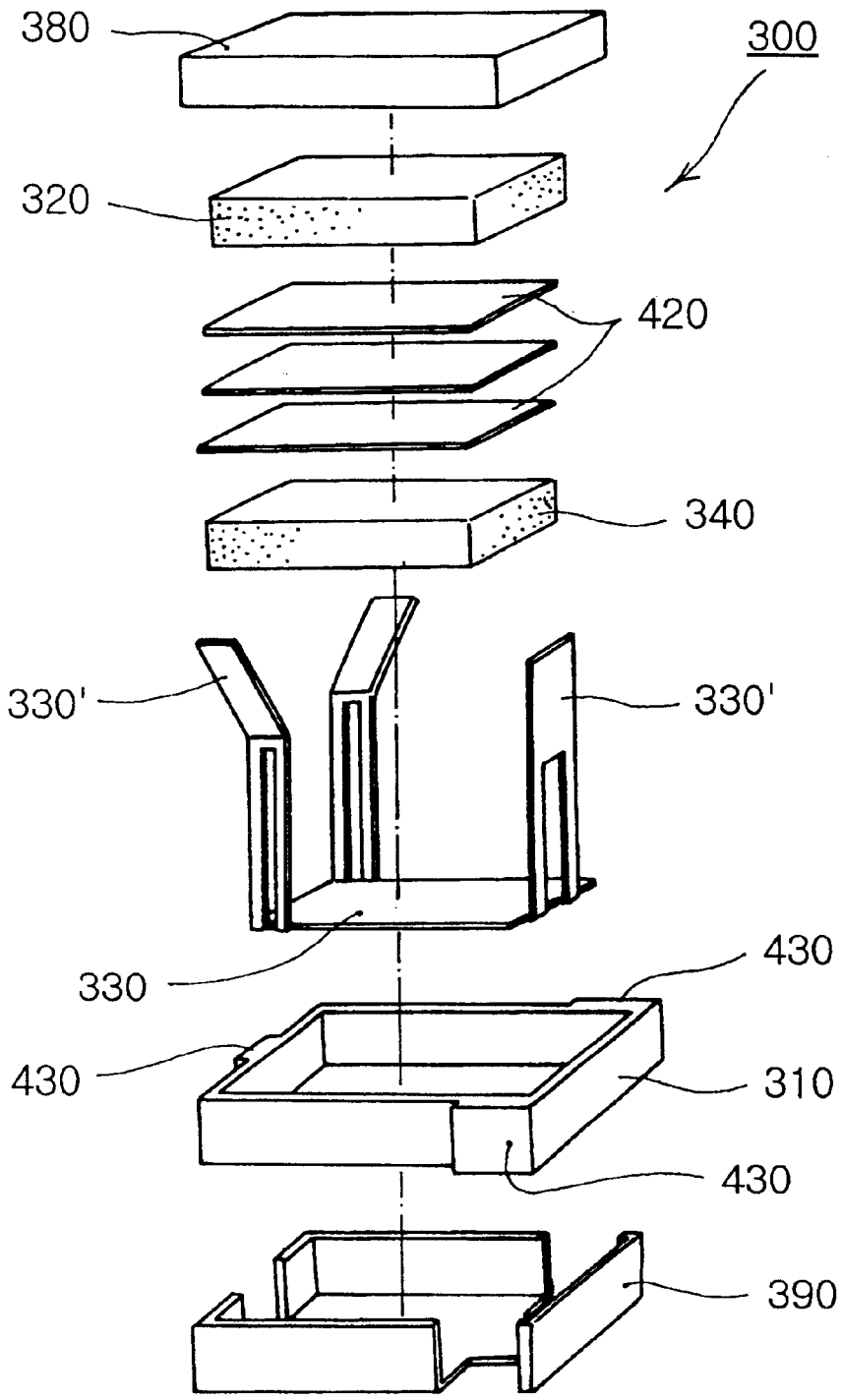
FIG. 9 is an exploded perspective view showing the constitution of another embodiment of the isolator according to the present invention.

Meanwhile, FIG. 9 is an exploded perspective view showing the constitution of another embodiment of the isolator according to the present invention. As shown in this drawing, in the isolator 300, a ferromagnetic sheet 320 which generates a constant magnetic field is installed within a shielding case 310 which is made of a synthetic resin. Under the ferromagnetic sheet 320, there are disposed a plurality of insulating films 420 which is made of polyimide. Under the plurality of the insulating films, there is disposed a garnet ferrite 340 which generates an induced magnetic field. An internal terminal sheet 330 is disposed under the garnet ferrite 340. Further, a plurality of strip lines 330' extend from the internal terminal sheet 330 to above the garnet ferrite.

Under this condition, the strip lines 330 of the internal terminal sheet 330 are connected to the chip resistor 360, to the three dielectric devices 350*a*–350*c* and to the input/output terminals 370 by soldering.

Figure 10:
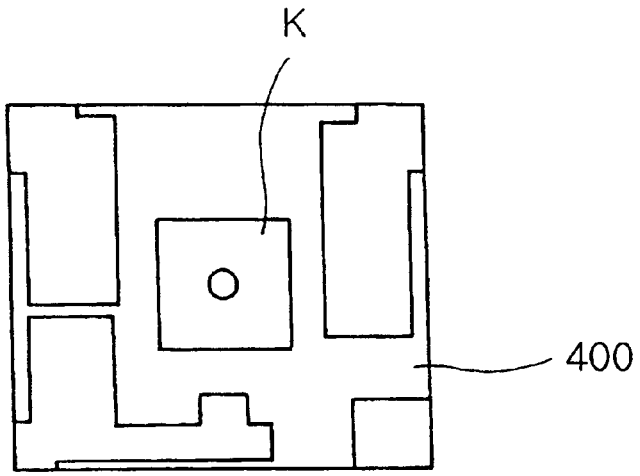
FIG. 10 is a plan view of the PCB on which the isolator of FIG. 9 is installed.
Figure 11:
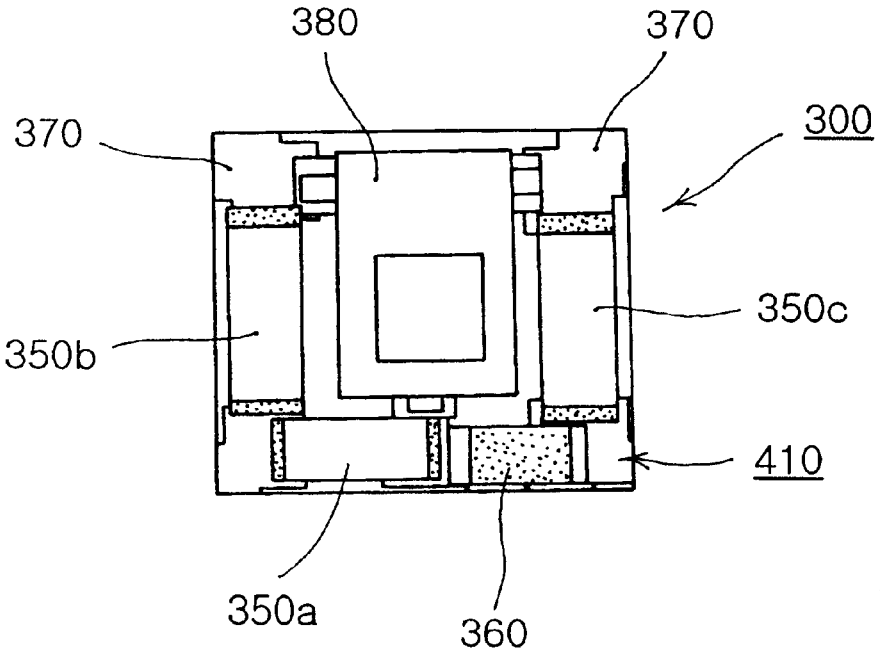
FIG. 11 is a plan view showing a status in which the isolator of FIG. 9 is installed on a PCB.

Meanwhile, the internal terminal sheet 330 (with the strip lines 330' extending up from it), the plurality of the insulating films 420, the garnet ferrite 340 and the ferromagnetic sheet 320 are inserted into the shielding resin case 310 in the cited order. The shielding resin case 310 is inserted into the lower case which serves as a ground. Then as shown in FIGS. 10 and 11, the three dielectric devices 350*a*–350*c* and the chip resistor 360 are installed on the PCB 400 and around the lower case 390. Then a connecting terminal part 410 with input/output terminals 370 inserted therein is formed.

Thus in the isolator 300, the internal terminal sheet 330 (with the strip lines 330' extending up from it), the plurality of the insulating films 420, the garnet ferrite 340 and the ferromagnetic sheet 320 are inserted into the shielding resin case 310 in the cited order, which is made of a synthetic resin. Then this structure is accommodated within and between upper and lower cases 380 and 390, and this assembled isolator 300 is installed on the PCB 400. Therefore, the variations of the magnetic field due to the damage or loose movements during its assembling can be inhibited, thereby reinforcing the leakage magnetic flux shielding effect.

Meanwhile, when the lower case 390 with the shielding case 310 installed therein is installed on the PCB 400, that is, when the isolator 300 is installed on the PCB 400, a securing recess K can be formed on the PCB 400.

Further, the three strip lines 330' of the internal terminal sheet 330 are drawn to the outside of the shielding case 310, so that the strip lines 330' would be contacted to the three dielectric devices 350*a*–350*c* and to the chip resistor 360. Under this condition, the shielding case 310 is provided with guide projections 430 for guiding the strip lines 330', and in this manner, any contact with the lower case 390 is prevented.

Accordingly, the internal terminal sheet 330, the garnet ferrite 340 and the ferromagnetic sheet 320 are inserted into the shielding case 310 which is made of a synthetic resin. Therefore, the isolator of the present invention has an insulating characteristic. The strip lines 330' of the internal terminal sheet 330 are connected to the connecting terminal part 410 which is disposed on the PCB 400. Therefore, in the isolator of the present invention, the bulk can be made compact, and its installation on the PCB 400 is convenient.

According to the present invention as described above, the ferromagnetic sheet together with the garnet ferrite and the internal terminal sheet (with the strip lines extending from it) is inserted into the shielding case of the isolator. Therefore, the leakage magnetic flux shielding effect is reinforced, and the magnetic shielding effect can be maximized. Further, the three dielectric devices and the chip resistor are installed on the PCB and around the lower case, and a connecting terminal part is formed adjacently. Therefore, the bulk of the isolator is made compact, the frequency response is made easy, the product characteristics are made reliable, the installation of the product on the PCB is made convenient, the assemblability of the product is improved, and the production line is simplified.

In the above, the present invention was described based on the specific embodiments and the attached drawings, but it should be apparent to those ordinarily skilled in the art that various changes and modifications can be added without departing from the spirit and scope of the present invention which will be defined in the appended claims.

What is claimed is:

1. An isolator installed between a power amplifier module and an antenna switch, for transmitting output signals of said power amplifier module to said antenna switch, and for absorbing reflected signals from said antenna switch so as to protect said power amplifier module, said isolator comprising:

upper and lower cases (180 and 190);

a ferromagnetic sheet (120) disposed within a shielding case (110), for generating a constant magnetic field;

a garnet ferrite (140) for generating an induced magnetic field;

an internal terminal sheet (130) having a plurality of strip lines (130') for connection to input/output electrode terminals (170) and a ground terminal, and disposed under said ferromagnetic sheet (120) and said garnet ferrite (140); and said input/output electrode terminals and a chip resistor (160) and three dielectric devices (150*a*–150*c*) being connected to said three strip lines (130') of said internal terminal sheet (130), wherein said ferromagnetic sheet (120) is inserted into said shielding case (110) together with said garnet ferrite (140) and said internal terminal sheet (130) with said strip lines (130') extending therefrom, said shielding case (110) is inserted into said upper and lower metal cases (180 and 190), said three dielectric devices (150*a*–150*c*) and said chip resistor (160) are installed on a circuit board (200) and around the outside of said lower metal case (190), and a connecting terminal part (210) having said input/output electrode terminals (170) is formed on the circuit board (200).

2. The isolator as claimed in claim 1, wherein said three strip lines (130') extending from said internal terminal sheet (130) to an outside of said shielding case are connected to said three dielectric devices (150*a*–150*c*) and to said input/output terminals (170) of said circuit board (200) by soldering.

3. The isolator as claimed in claim 1, wherein said three dielectric devices (150*a*–150*c*) upstand on said circuit board (200) and around said shielding case (110).

4. The isolator as claimed in claim 1, wherein said shielding case (110) is made of an insulating synthetic resin.

5. The isolator of claim 1, wherein the circuit board and the dielectric devices and the chip resistor disposed thereon are located outside a housing defined by said upper and lower cases, said sheilding case with the ferromagnetic sheet and the garnet ferrite contained therein are placed inside said housing.

6. The isolator of claim 5, wherein said lower case is placed on the circuit board.

7. An isolator, comprising: upper and lower cases (380 and 390);

a ferromagnetic sheet (320) disposed within a shielding case (310), for generating a constant magnetic field;

a garnet ferrite (140) for generating an induced magnetic field;

an internal terminal sheet (330) having a plurality of strip lines (330') for connection to input/output electrode terminals (370)and to a ground terminal, and disposed under said ferromagnetic sheet (320) and said garnet ferrite (340); and said input/output electrode terminals and a chip resistor (360) and three dielectric devices (350*a*–350*c*) for being connected to said three strip lines (330)' of said internal terminal sheet (330), wherein said ferromagnetic sheet (320) is inserted into said shielding resin case (310) together with said garnet ferrite (340) and said internal terminal sheet (330) with said strip lines (330') extending therefrom and a plurality of insulating films (420), said shielding case (310) is inserted into said lower metal case (390) serving as a ground, said three dielectric devices (350*a*–350*c*) and said chip resistor (360) are installed on a circuit board (400) and around the outside of said lower metal case (390), and a connecting terminal part (410) having said input/output electrode terminals (370) is formed on the circuit board (400).

8. The isolator as claimed in claim 7, wherein said three strip lines (330') extending from said internal terminal sheet (330) to an outside are connected to said three dielectric devices (350*a*–350*c*) and to said chip resistor (360) of said circuit board (400) by soldering.

9. The isolator as claimed in claim 7, wherein said shielding case (310) is provided with guide projections (430) at angular intervals of about 120 degrees, for guiding said strip lines (330') which extend to an outside of said shielding case.

10. The isolator as claimed in claim 7, wherein said shielding case (310) is injection-molded from an insulating synthetic resin.

11. The isolator as claimed in claim 7, wherein said lower case (390) with said shielding case (310) inserted therein is installed on said circuit board (400), and a securing recess (K) is formed on said circuit board (400) to secure said lower case (390).

12. The isolator as claimed in claim 11, wherein said three strip lines (330') extending from said internal terminal sheet (330) to an outside are connecting to said three dielectric devices (350*a*–350*c*) and the said chip resistor (360) of said circuit board (400) by soldering.

13. The isolator of claim 7, wherein the circuit board and the dielectric devices and the chip resistor disposed thereon are located outside a housing defined by said upper and lower cases, said shielding case with the ferromagnetic sheet and the garnet ferrite contained therein are placed inside said housing.

14. The isolator of claim 13, wherein said lower case is placed in a recess formed on the circuit board.

* * * * *